United States Patent [19]

Yamada et al.

[11] Patent Number: 5,022,932

[45] Date of Patent: Jun. 11, 1991

[54] RAPID SOLIDIFICATION OF METAL-METAL COMPOSITES HAVING AG, AU OR CU ATRIX

[75] Inventors: Shuji Yamada; Koji Tsuji; Yoshinobu Takegawa, all of Kadoma; Akira Tanimura, Amagasaki; Akira Menju, Amagasaki; Nobuyoshi Yano, Amagasaki, all of Japan

[73] Assignees: Matsushita Electric Works, Ltd., Osaka; Unitika, Ltd., Hyogo, both of Japan

[21] Appl. No.: 468,210

[22] Filed: Jan. 22, 1990

Related U.S. Application Data

[62] Division of Ser. No. 171,700, Mar. 22, 1988, Pat. No. 4,911,769.

[30] Foreign Application Priority Data

Mar. 25, 1987 [JP] Japan ..... 62-70683
Mar. 25, 1987 [JP] Japan ..... 62-70694

[51] Int. Cl.[5] ..... C22C 9/00

[52] U.S. Cl. ..... 148/13.1; 148/430; 148/431; 148/432; 420/590; 428/614; 428/671; 428/672; 428/673

[58] Field of Search ..... 148/430, 431, 432, 13.1; 428/614, 671, 672, 673; 75/355; 420/590

[56] References Cited

U.S. PATENT DOCUMENTS

| | | | |
|---|---|---|---|
| 2,365,249 | 12/1944 | Comstock | 420/501 |
| 3,880,777 | 4/1975 | Shibata | 252/514 |
| 4,279,649 | 7/1981 | Fujiwara et al. | 148/431 |
| 4,387,073 | 6/1983 | Westbrook | 420/507 |
| 4,396,420 | 8/1983 | Schmidberger et al. | 75/355 |
| 4,540,546 | 9/1985 | Giessen | 420/590 |
| 4,626,410 | 12/1986 | Miura et al. | 420/590 |
| 4,744,947 | 5/1988 | Nilmen et al. | 148/432 |
| 4,891,059 | 1/1990 | Diamond et al. | 420/590 |
| 4,897,110 | 1/1990 | Kock et al. | 75/355 |

FOREIGN PATENT DOCUMENTS

| | | |
|---|---|---|
| 0153895 | 2/1982 | Fed. Rep. of Germany . |
| 0147827 | 7/1986 | Japan . |
| 0288032 | 12/1986 | Japan . |
| 1835 | 1/1987 | Japan . |
| 077439 | 4/1987 | Japan . |

*Primary Examiner*—Upendra Roy
*Attorney, Agent, or Firm*—Burns, Doane, Swecker & Mathis

[57] ABSTRACT

An electrically conductive composite material is formed by dispersing in a matrix metal the other metal which is not solid soluble with the matrix metal. The other metal is finely divided to an extent of not excessively lowering the conductivity and is mixed in the matrix metal in a particle amount with which respective particles keep a mutual distance effective to strengthen the composite material, whereby the material is sufficiently improved in the mechanical strength and wear resistance and remarkably reduced in the high temperature deformation. Such conductive composite material can be obtained through a melt atomization.

9 Claims, 2 Drawing Sheets

RAPID SOLIDIFICATION OF METAL-METAL COMPOSITES HAVING AG, AU OR CU ATRIX

This application is a divisional, of application Ser. No. 07/171,700, filed Mar. 22, 1988.

TECHNICAL BACKGROUND OF THE INVENTION

This invention relates to a composite conductive material and, more particularly, to such material in which particles of at least a sort of metal are dispersed within a matrix conductive metal for elevating its strength, the metals being mutually not solid soluble at a normal temperature, and to a method for manufacturing such composite material, as well as to an electric contact material obtained from the composite conductive material.

The electric contact material obtained from the composite conductive material of the kind referred to can be effectively utilized as electric contacts in such various electric devices and equipments as relays, brakers, power-type relays and the like.

DISCLOSURE OF PRIOR ART

It has been generally practiced to obtain strengthened composite conductive materials by dispersing in such conductive material as Ag, Au, Cu and the like some other metal particles, in which event it has been an issue, from the view point of the strength, at which distance the respective particles of the other metal are to be dispersed in the conductive material. That is, any dislocation caused in the composite material upon application of an external force thereto moves so that a deformation will take place in the material, while this deformation becomes unlikely to easily take place when the dislocation is made difficult to move and the hardness is thereby elevated. An external force $\sigma$ required for moving the dislocation is represented by a formula $\sigma=\mu b/2\pi\lambda$ (in which $\mu$ being the modulus of rigidity, b being the berger's vactor, and " being the distance between the respective metal particles). When the distance $\lambda$ is made smaller in this formula, the force $\sigma$ becomes larger so that the dislocation will be harder to render the material not easily deform, and a hard composite conductive material can be prepared. To make the distance between the particles smaller, the metal particles to be dispersed may be made finely small and their content may be increased.

There has been suggested in the U.S. Pat. No. 3,880,777 to Akira Shibata, on the other hand, an electrical contact material containing, as dispersed in Ag and as internally oxidized, at least two of Zn, Sn and Sb as well as one of Group IIa elements in the Periodic Table added along with Ni or Co, in attempt to have the contact material provided with both the anti-welding property and low contact resistance, but this contact material has not been satisfactory in attaining a high level strengthening.

Further, in Japanese Patent Laid-Open Publication No. 61-147827, there have been disclosed an electrical contact material containing, as uniformly dispersed in Ag, Ni particles of 1 to 20 microns and fine submicron Ni particles, and a method of producing such material. In this contact material, however, the dispersed Ni particles are of such a wide range of size as 1 to 20 microns, so that the distance between the particles cannot be made sufficiently smaller so as not to be capable of decreasing $\lambda$ in the above formula, whereby the dislocation has been still left easily movable and the strength has not been remarkably improved. It has been also found that the particles of 1 to 20 microns and certain submicron particles have been practically still unable to simultaneously exist according to such level of technique as in this laid-open publication.

TECHNICAL FIELD

A primary object of the present invention is, therefore, to provide a composite conductive material which can be made high in the hardness but low in the viscosity and less deformable at higher temperature, without substantial change in the electric properties, to provide a method for manufacturing such a material, and further to provide an electric contact material of the composite conductive material.

According to the present invention, this object can be attained by providing a composite conductive material formed by dispersing in a matrix metal the other metal which is not solid soluble at a normal temperature with the matrix metal for strengthening the material, wherein the other metal is at least one sort of metal of a particle size of 0.01 to 1 $\mu$m and at a ratio of 0.5 to 20 wt% of total weight of the matrix metal and the other metal.

Other objects and advantages of the present invention shall be made clear in following description of the invention detailed with reference to preferred examples in conjunction with accompanying drawings.

Figure 1:
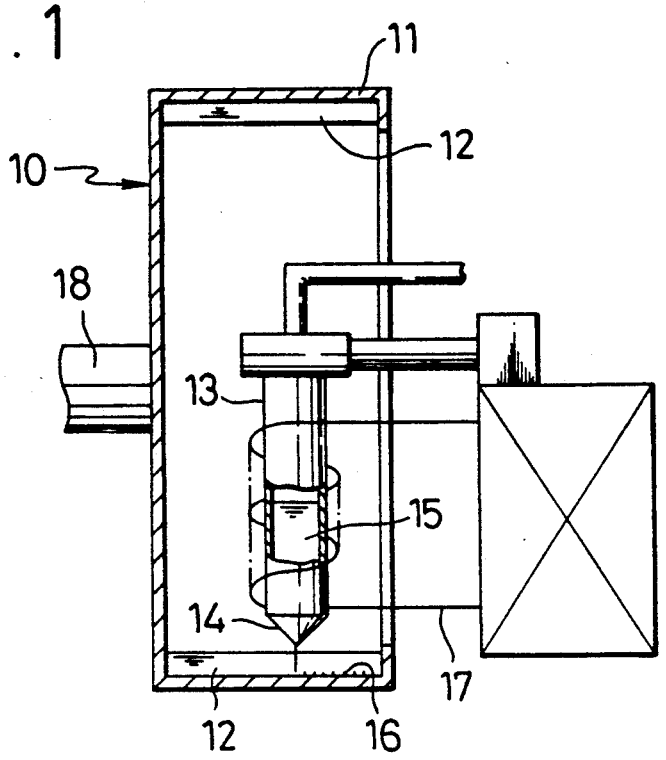
FIG. 1 is a schematic sectioned view of a device employed for a rotating water atomization in the method for manufacturing the composite conductive material according to the present invention.

While the present invention will be detailed in the followings with reference to the preferred examples, it should be appreciated that the intention is not to limit the invention only to such examples but to rather include all modifications, alterations and equivalent arrangements possible within the scope of appended claims.

DISCLOSURE OF PREFERRED EXAMPLES

In the composite conductive material according to the present invention, there is dispersed in a matrix metal A a metal B which is not solid soluble at a normal temperature with the matrix metal A. Here, this metal B not solid soluble at the normal temperature with the matrix metal is to be the one which does not form a uniform solid phase with the matrix metal A, that is, any solid solution, at a normal temperature, while not limited to be the one that never form the solid solution but is to include the one which is low in the solid solubility. Further, while it is not restricted, it is preferable that the matrix metal A and the other metal B will be in a uniform liquid phase in their molten state, since the other metal B is susceptible to uniformly disperse as finely divided within the matrix metal A when they turn to be in the solid phase.

For the matrix metal A, Ag is to be employed but Au or Cu appears to be also employable. The other metal B may be selected in various manners depending on the matrix metal A employed and, while not specifically limited, Ni, Fe and Co may suitably be employed as the other metal B when the matrix metal A is, for example, Ag, and such others as Cr, Si, Rh and V appear also employable. In all events, at least a metal selected from these groups can be employed as the other metal B. When the matrix metal A is Au, at least a metal selected from a group consisting of Ge, Si, Sb and Rh appears employable as the other metal and, when the matrix metal A is Cu, the other metal B should preferably be Fe. With such combination of the matrix metal A and the other metal B as herein referred to, the dispersion of the other metal B will be made fine and uniform.

It is necessary that the amount of the other metal B to be dispersed is made to be 0.5 to 20 wt%, optimumly 1 to 10 wt%, of the total weight of the matrix metal A and the other metal B. When the amount of the other metal B is less than 0.5%, the amount of dispersed particles becomes less to render the mutual distance between the particles to be larger to lower the metal strengthening action. When, the amount of the other metal B exceeds 20%, an amount of any larger particles which are independent and do not finely disperse is increased.

It is also necessary that the other metal B is dispersed in the matrix metal A in the form of particles of a size 0.01 to 1 μm, because with a particle size below 0.01 μm the conductivity of the matrix metal A shows a tendency of getting lowered while a size over 1 μm shows a deterioration in the metal strengthening action due to the dispersion. In practice, however, there arises no substantial problem even when the particles of the other metal B of a size above 1 μm and below 5 μm are mixed, so long as they are less than about 5 wt% of the entire metal B dispersed in the particles of the matrix metal A.

According to a feature of the present invention, further, the composite conductive material can be prepared in a powder in which the metal B particles which do not form any solid solution in the matrix metal A are uniformly, finely dispersed by melting the matrix metal A and the other metal B not forming any solid solution with the metal A at the atmospheric temperature, and mixing them with each other, rapidly cooling to solidify them, Here, it is preferable that a melt of the matrix metal A and the other metal B will be rapidly cooled to solidify at a cooling rate of more than $10^{4}$° C./sec. For such rapid cooling and solidifying, there are enumerated a rotating water atomization, high pressure gas atomization, water jetting, belt conveying, cavitation and the like methods. In obtaining, in particular, the composite conductive material of uniformly spherical powder, the rotating water atomization should preferably be employed, while the high pressure gas atomization of a higher cooling rate is preferable in obtaining a high quality composite conductive material. The rotating water atomization is a method employing a rotating water spinning device for fabricating amorphous metal fiber, in which the molten state metals admixed are jetted against an inner peripheral wall of a rotary drum on which wall a filmy water layer is spread so as to have the metals rapidly cooled and solidified into the powder.

Referring more specifically to the rapid cooling and solidification, it is required, for obtaining the cooling rate of more than $10^{4}$° C./sec. by the high pressure gas atomization, to render nozzle hole diameter to be small so as to control the atomization gas pressure at a higher level. Preferably, the nozzle hole diameter for the molten metal jetting is set to be below 7 mm, more preferably below 5 mm, or optimumly below 3 mm. When the diameter exceeds 7 mm, the cooling rate of more than $10^{4}$° C./sec. becomes difficult to be obtained so that, in the thus obtained composite conductive material, there will arise a tendency that larger size particles of the other metal B in a single phase are caused to be contained and their dispersibility is lowered. The atomization gas pressure should preferably be more than 20 kg/cm$^2$, more preferably above 30 kg/cm$^2$ and, optimumly, more than 50 kg/cm$^2$. When the pressure is less than 25 kg/cm$^2$, there arises a tendency that the cooling rate of more than $10^{4}$° C./sec. is difficult to be obtained so that the obtained composite conductive material involves a tendency of being caused to contain larger size particles of the metal B in a single phase to lower the dispersibility of the particles. It is preferable that an inert gas is employed as the high pressure atomization gas.

For the temperature of melt, that is, the molten state of the both metals A and B, it is necessary to keep the temperature higher than the melting point of the other metal B when nozzle clogging prevention as well as uniform dispersion in the melt are taken into account, preferably at a temperature higher than 100° C. or more preferably higher than 200° C.

In the case of attaining the cooling rate of more than $10^{4}$° C./sec. in the rotating water atomization, the nozzle hole diameter should also be properly selected. That is, the nozzle hole diameter for jetting the melt of the metals should preferably be 0.05 to 0.5 mm, more preferably be 0.07 to 0.3 mm or, optimumly, be 0.1 to 0.2 mm. When the size is larger than 0.5 mm, the cooling rate of more than $10^{4}$° C./sec. is difficult to be attained so that the obtained composite conductive material will be caused to contain larger size particles of the metal B in a single phase to lower the dispersibility of the particles. When the size is smaller than 0.05 mm, on the other hand, the nozzle hole is caused to be easily clogged.

Further, the flow rate of the cooling water should preferably be more than 200 m/min., more preferably more than 300 m/min. or, optimumly, more than 400 m/min. since the cooling rate of more than $10^{4}$° C./sec is difficult to be attained with a flow rate lower than 200 m/sec. so that thereby obtained composite conductive material will be caused to contain larger size particles of the metal B in a single phase to lower the dispersibility of the particles. The temperature of the melt of metals should preferably be higher by more than 100° C. than the melting point of the other metal B or, optimumly, more than 200° C.

In increasing the cooling rate, the cooling water is at a temperature below 10° C. or, optimumly, below 4° C. In this case, the nozzle hole and cooling water should preferably be at a distance less than 10 mm or, optimumly, less than 5 mm. Further, the melt of metals is jetted toward the cooling water at an angle of preferably more than 20° with respect to the surface of the cooling water or, optimumly, more than 60° .

In order that the other metal B is dispersed more finely and uniformly, the melt of metals may be subjected to an agitation, in which event a measure may be taken in such that a high frequency coil is provided about outer surface of the nozzle for causing the melt inside the nozzle subjected to an agitation and to a high frequency heating, or to an ultrasonic oscillation for restraining any two phase separation. There may be taken another measure of providing inside the nozzle another coil for the melt agitation so as to adjust the two phase separation of the metal B. It is also effective to provide within the nozzle at a position downstream of the agitating coil and the nozzle hole, a dam or a ceramic filter, so as to restrain any segregation of alloy components in the melt.

The rotating water atomization shall be explain more concretely in the followings. In manufacturing Ag - 4.6 wt% Ni alloy powder, Ag and Ni are put in a graphite crucible at a ratio of Ag 95.4 wt% and Ni 4.6 wt% and made to be at a melting temperature of 1,650° C. by means of a high frequency melting. Resulting melt is then jetted out of a nozzle hole of a diameter 0.1 to 0.2 mm into a water film formed on the inner peripheral wall of a rotary drum.

Figure 2:
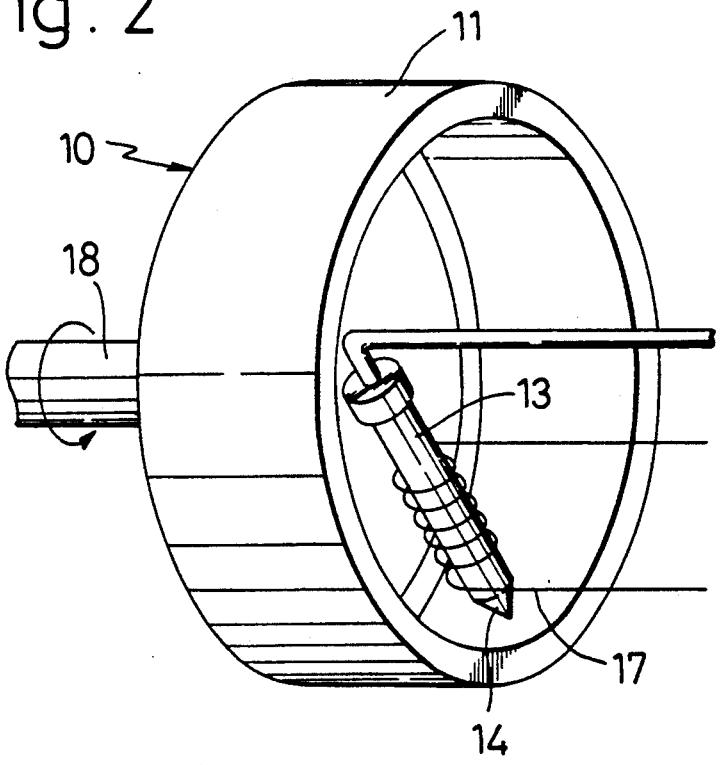
FIG. 2 shows the device of FIG. 1 in perspective view.

In FIGS. 1 and 2, there is shown an example of the device employable for the rotating water atomization, in which the device denoted by 10 comprises rotary drum 11, and a filmy cooling fluid 12 is formed on the inner peripheral wall of the drum 11 due to the centrifugal force upon rotation of the drum about its longitudinal axis. The matrix metal A and the other metal B are placed in a jetting furnace 13 having a nozzle 14 and formed therein into a melt 15, and this melt 15 is jetted out of the nozzle 14 into the cooling fluid 12 to be thereby rapidly cooled to form powder 16. The furnace 13 is provided with a heating coil 17 so that a desired temperature will be attained in the furnace, while an axial driving means 18 is coupled to the rotary drum 11 for a desired rotating speed.

It has been found that, with the rotating water atomization employing such device as above, Ni particles of about 0.5 μm are uniformly dispersed in Ag of the solidified powder obtained by rapidly cooling Ag - 4.6 wt% Ni.

While in the above the composite conductive material has been referred to as being obtained in the powdery state, it is of course possible to obtain it in any other state than the powdery state, such as strip, wire, fibrous and the like states, without being required to be limited in the form of product.

In the composite conductive material thus obtained according to the present invention, the other metal B is dispersed as extremely finely divided and uniformly within the matrix metal A, whereby the material is provided with a high level of hardness so as to be not susceptible to deform and as to remarkably lower the mutual viscosity between pieces of the same material. While, further, the hardness of the material at normal temperature is made high to lower the wearability, there has been seen no deterioration in the electrical properties as compared with conventional materials. In this case, the electrical properties vary in dependence on the electric conductivity and content of the other metal B dispersed in the matrix metal A. With the metal B particles of a size about 0.01 to 1 μm and dispersed at a rate of 0.5 to 20 wt% with respect to the total weight of the both metals A and B, however, there has been seen no substantial influence on the electrical conductivity. Accordingly, the composite conductive material according to the present invention should find a wide range of use, such as electric parts, conductive pastes and so on.

Figure 3:
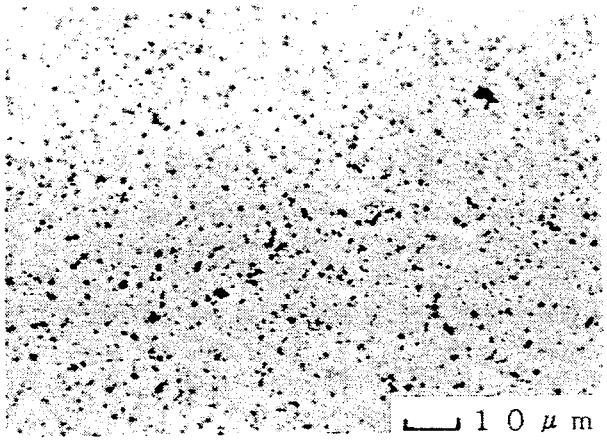
FIG. 3 is a microscopic photograph of the material according to the present invention.

In particular, the composite conductive material can be applied into an electric contact material by forming the composite material into any desired configuration. To this end, optimumly, the composite conductive material is hot-pressed and sintered when the material is in powdery form, and the sintered material is then subjected to a wire drawing through a hot-extrusion so as to be the electric contact material, while any other forming may be employed. The electric contact material thus obtained in a wire form through the wire drawing may be formed into any desired shape by means of a header or the like, so as to be the electric contact. Of course, the shape of the electric contact material may not be limited to the wire but be any others as desired. Instead of the particle powder as in the above, any other mode of the composite conductive material of, for example, wire or strip shape may suitably be employed for obtaining the electric contact material. When the contact material is prepared from the wire-or strip-shaped composite material, the sintering step may be omitted and only a cutting or punching step may suffice the purpose. In the case of the composite conductive material obtained through the rapid cooling solidification of the melt of Ag - 4.6 Ni, consisting thus of Ag 95.4 wt% and Ni 4.6 wt%, according to the present invention, as will be clear in view of the microscopic photograph of FIG. 3, Ni particles are uniformly dispersed in Ag while keeping a sufficient mutual distance so as to attain a high level strengthening of the material.

Figure 4:
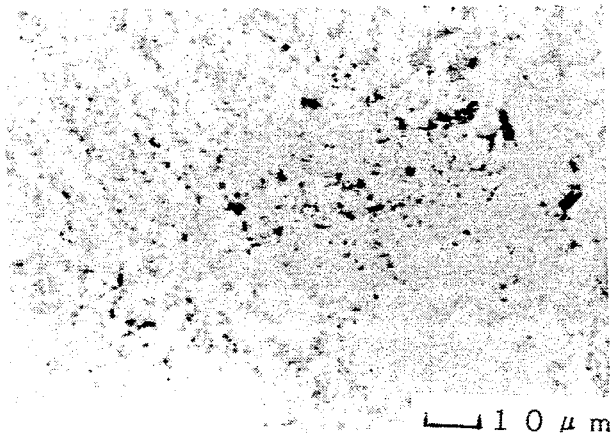
FIGS. 4 and 5 are microscopic photographs of referential examples.
Figure 5:
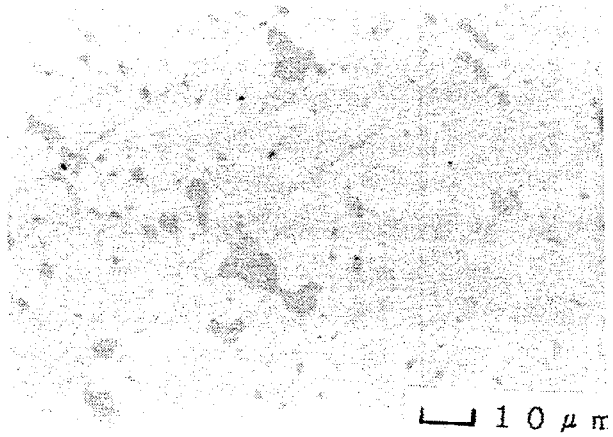

In a composite conductive material prepared from a mixture of 95 wt% Ag powder of 0.07 μm and 5 wt% Ni powder of 0.02 μm by forming, hot-pressing and sintering as already mentioned, a microscopic photograph of FIG. 4 of this material shows that many of Ni particles cohere to reach a size of 1 to 10 μm so that a favorable mutual distance cannot be attained any more, to render the strengthening insufficient. In a further microscopic photograph in FIG. 5 of a composite material prepared from Ag - 5 Ni of a particle size of several μm to 50 μm, it is seen that more larger Ni particles than in the case of FIG. 4 are present so that the mutual distance is further decreased to render the strengthening of the material to be impossible.

Examples in which the present invention is practiced shall now be referred to in the followings.

EXAMPLE 1:

Ag and Ni were put in a graphite crucible at a ratio of Ag 95 wt% and Ni 5 wt%, and were subjected to a melting temperature of 1,650° C. by means of a high frequency melting. Obtained melt was jetted out of a hole of a diameter of 120 μm of a ruby-made nozzle under an argon back pressure of 4.5 kg/cm$^2$, into a water film of 4° C. formed on the inner peripheral wall of a drum of a diameter 600 mm and rotated at 500 rpm. Jetting angle formed by the water film and jetted melt was made at 60° , and the nozzle's tip end was at a distance of 4 mm from water surface, whereby a powdery composite conductive material of a particle size 100 to 200 μm was prepared and the material was annealed in an Ar atmosphere at 850° C. for 3 hours.

EXAMPLE 2:

Ag and Ni were put in a graphite crucible at a ratio of Ag 90 wt% and Ni 10 wt%, and were made to a melt of 1,750° C. by means of a high frequency melting. Obtained melt was jetted out of a hole of a diameter 3 mm of a ruby-made nozzle under an argon back pressure of 1 kg/cm$^2$, such jetted melt flow was atomized with a high pressure argon gas of 70 kg/cm$^2$ (high pressure gas atomization), thus obtained rapid-cooled and solidified powder was then annealed in the same manner as in Example 1.

EXAMPLES 3 to 6:

Except that Ag as the matrix metal A and Ni as the other metal B in the above EXAMPLE 1 were replaced by such metals as in TABLE I in the following, at such ratio also as listed in TABLE I, the powdery composite conductive material was obtained and annealed.

COMPARATIVE EXAMPLE 1

Ag powder and Ni powder of less than 350 mesh were mixed at such a ratio as shown also in TABLE I, the mixture was placed in a metal die heated at 400° C. and formed under 10 ton/cm$^2$, and thus formed product was annealed for 3 hours in an Ar atmosphere kept at 850° C.

COMPARATIVE EXAMPLES 2 to 4

Except that Ag as the matrix metal A in the foregoing EXAMPLE 1 as well as Ni as the other metal B were replaced by such metals as,in TABLE I at such ratios as also shown therein, powdery composite conductive materials were obtained and annealed in the same manner as in EXAMPLE 1.

With respect to the respective annealed powders and materials through these EXAMPLES and COMPARATIVE EXAMPLES, measurements of the hardness were carried out with a micro-Vickers hardness meter, while applying a load of 100g for 15 seconds, resulting measurements were as listed also in TABLE I.

TABLE I

| | Comp. A:B | Content (wt %) | Particle Size (μm) | Hardness (Hv) |
|---|---|---|---|---|
| EX. 1 | Ag:Ni | 95:5 | 0.5 | 55 |
| EX. 2 | Ag:Ni | 90:10 | 0.5 | 70 |
| EX. 3 | Ag:Ni | 99:1 | 0.5 | 50 |
| EX. 4 | Ag:Fe | 99:1 | 0.7 | 45 |
| EX. 5 | Ag:Fe | 90:10 | 0.6 | 60 |
| EX. 6 | Ag:Co | 95:5 | 0.6 | 50 |
| COMP. | | | | |
| EX. 1 | Ag:Ni | 95:5 | 1-20 | 28 |
| EX. 2 | Ag:Ni | 99.9:0.1 | 0.5 | 30 |
| EX. 3 | Ag:Ni | 75:25 | 0.5<br>100-200 | 40 |
| EX. 4 | Ag:Fe | 99.9:0.1 | 0.2 | 30 |

As would be clear in view of the above TABLE 1, the composite conductive materials according to the present invention have been high in the hardness, and there has been present no metal B particles of a size larger than 1 μm. On the other hand, the composite compound materials according to COMPARATIVE EXAMPLES were low in the hardness and, specifically in the case of COMPARATIVE EXAMPLE 3, there were present mixedly smaller particles of 0.05 μm and larger particles of 100-200 μm so that there could not attain any sufficient hardness.

With respect to the materials obtained by EXAMPLE 1 and COMPARATIVE EXAMPLE 1, measurements of the Vicker's hardness under high temperature condition were carried out, and such results as shown in following TABLE I-a were obtained, the conditions for the measurement having been a load of 1 kg and a time for 15 seconds:

TABLE I-a

| | 25° C. | 300° C. | 500° C. | 700° C. |
|---|---|---|---|---|
| EXAMPLE 1 | 65 | 40 | 24 | 12 |
| COMP. EX. 1 | 30 | 20 | 12 | 7 |

It would be seen in the above that the material according to the present invention has been improved also in the hardness at higher temperatures, because of the dispersion in Ag of Ni particles in uniform and fine manner.

EXAMPLES 7 to 9 & COMPARATIVE EXAMPLES 5-7

Ag and Ni were put in a graphite crucible at a ratio of Ag 95 wt% and Ni 5 wt% and melted at melting temperature of 1,650° C. Their melt was jetted out of such nozzle diameters and cooling water flow rate as shown in TABLE II, under argon back pressure 4.5 kg/cm$^2$ into water film at 4° C. formed on the inner peripheral wall of a rotating drum of a diameter 600 mm, and at a jetting angle 60° formed by the jetted melt and water film surface, while the nozzle's tip end was at a distance of 4 mm from the water surface. Thus obtained composite conductive materials were annealed at 850° C. for 3 hours.

The hardness of the thus obtained material as annealed as well as the particle size of the Ni particles dispersed in Ag were measured, results of which have been as listed in following TABLE II.

TABLE II

| | Nozzle Hole Dia. (mm) | Cooling Fluid Flow Rate (m/min) | Ni Particle Size (μm) | Hardness (Hv) |
|---|---|---|---|---|
| EX. 7 | 0.10 | 680 | 0.3 | 50 |
| EX. 8 | 0.24 | 980 | 0.4 | 53 |
| EX. 9 | 0.17 | 860 | 0.6 | 57 |
| COMP. | | | | |
| EX. 5 | 0.03 | 700 | — | — |
| EX. 6 | 0.15 | 160 | 2-30 | 35 |
| EX. 7 | 0.7 | 830 | 3-40 | 31 |

As would be clear from the above TABLE II, the composite conductive materials have been high in the hardness, and there was contained substantially no Ni particle as the other metal B of a size larger than 1 μm. In COMPARATIVE EXAMPLE 5, on the other hand, the nozzle hole diameter 0.03 mm was too small and its clogging took place so as not to be able to obtain any material. In the case of COMPARATIVE EXAMPLES 6 and 7, Ni particles of 2 to 40 μm were made to disperse while certain single phase Ni particles in a range of 40 to 300 μm were also produced, and only insufficient hardness could be gained.

EXAMPLES 10 & 11 & COMPARATIVE EXAMPLES 8 & 9:

90 wt% of Ag and 10 wt% of Ni were put in the graphite crucible, and made into a melt at 1,750° C. of a high frequency melting. The melt was jetted out of a ruby-made nozzle hole of such diameters and jetting has pressures as listed in following TABLE III, under an argon back pressure of 1.0 kg/cm$^2$ to form the composite conductive materials, which were then annealed at 850° C. for 3 hours within an Ar atmosphere.

The hardness of the annealed materials and Ni particle size dispersed in Ag were measured, results of which were as in following TABLE III.

TABLE III

| | Nozzle Hole Dia. (mm) | Jet. Gas Press. (kg/cm$^2$) | Ni Particle Size (μm) | Hardness (Hv) |
|---|---|---|---|---|
| EX. 10 | 2.0 | 90 | 0.3 | 52 |
| EX. 11 | 3.0 | 70 | 0.5 | 57 |
| COMP. | | | | |

TABLE III-continued

| | Nozzle Hole Dia. (mm) | Jet. Gas Press. (kg/cm²) | Ni Particle Size (μm) | Hardness (Hv) |
|---|---|---|---|---|
| EX. 8 | 4.0 | 15 | 6-50 | 34 |
| EX. 9 | 10.0 | 50 | 3-20 | 38 |

As could be seen in the above TABLE III, the composite compound materials according to the present invention have shown, respectively, a high hardness while containing substantially no Ni particles of a size larger than 1 μm. In contrast, COMPARATIVE EXAMPLE 8 was of a jetting gas pressure which was too low, and COMPARATIVE EXAMPLE 9 was of too large nozzle diameter so as to lower the cooling rate, whereby the Ni particles dispersed in Ag were larger while containing larger size Ni particles of a single phase, so as not to render the hardness to be higher.

EXAMPLE 12:

Ag and Ni were placed in a graphite crucible at a ratio of Ag 90 wt% and Ni 10 wt%, and were made into a melt of 1,650° C. by means of a high frequency melting. The melt was jetted out of a ruby-made nozzle of a hole diameter 120 μm under an argon back pressure of 3 kg/cm², into a water film of 4° C. formed on inner peripheral wall of a drum of a diameter 500 mm and rotated at 300 rpm, and a powdery material of a particle size 50 to 200 μm was obtained, The powdery material was placed in a metal die kept at 400° C. to be formed as hot-pressed under 10 ton/cm², and this formed piece was sintered in an Ar atmosphere at 850° C. for 3 hours.

Thus obtained sintered member was subjected to repetitive wire drawing of hot-extrusion at 700° C. and annealing, to be made into a wire of a predetermined thickness, and rivet-shaped contacts were obtained as joined with Cu.

EXAMPLE 13:

Except for such change in the composition ratio of the metals as shown in a following TABLE IV, an electric contact was obtained in the same manner as in EXAMPLE 12.

EXAMPLE 14:

Ag and Ni were put in a graphite crucible at a ratio of Ag 90 wt% and Ni 10 wt%, and made into a melt of 1,750° C. by means of a high frequency melting. This melt was jetted out of a ruby-made nozzle of a hole diameter of 3 mm under an argon back pressure of 1 kg/cm², thus jetted melt stream was atomized by a high pressure Ar gas at 70 kg/cm² to be rapidly cooled and solidified, and a powdery composite material was obtained. This powdery material was processed in the same manner as in EXAMPLE 12 and an electric contact was thereby obtained.

EXAMPLES 15 to 21:

Except for such changes in the type of the metal B and composition ratio of the metals as listed in TABLE IV, various electric contacts were prepared in the same manner as in EXAMPLE 12.

COMPARATIVE EXAMPLE 10:

A carbonyl Ni powder of less than 350 mesh and electrolytic silver powder of less than 350 mesh were mixed at a ratio of Ag 90 wt% and Ni 10 wt% in a ball mill and were formed and sintered in the same manner as in EXAMPLE 1. Thus obtained sintered body was drawn into a wire through a hot-extrusion at 700° C. and then annealed. Repeating such drawing and annealing, a wire of a predetermined thickness was obtained, which was joined with Cu, and formed into rivet-shaped contacts.

COMPARATIVE EXAMPLES 11 to 14:

Except for such changes in the metal B and composition ratio of the metals as listed in TABLE IV, various electric contacts were prepared in the same manner as in EXAMPLE 12.

The respective electric contacts of the foregoing EXAMPLES 12 to 21 and COMPARATIVE EXAMPLES 10 to 14 were tested in respect of the number of welding and contact resistance, results of which tests were as in TABLE IV, the tests having been carried out for sample number N=3 of each contact by means of an ASTM tester. Contact opening and closing conditions were of an applied voltage of 100V, applied current of 40A, tripping force of 200g, contacting force of 140g, and repeated contact opening and closing of 50,000 times.

TABLE IV

| | Metals A:B | Content (wt %) | Welding (times) | Contact Resist. (mΩ) |
|---|---|---|---|---|
| Ex. 12 | Ag:Ni | 90:10 | 20 | 0.6 |
| EX. 13 | Ag:Ni | 99:1 | 120 | 0.5 |
| EX. 14 | Ag:Ni | 90:10 | 45 | 1.0 |
| EX. 15 | Ag:Fe | 90:10 | 55 | 0.65 |
| EX. 16 | Ag:Si | 95:5 | 70 | 0.8 |
| EX. 17 | Ag:Co | 99:1 | 130 | 0.7 |
| EX. 18 | Ag:Cr | 97:3 | 80 | 0.9 |
| EX. 19 | Ag:Fe | 90:10 | 55 | 1.0 |
| EX. 20 | Ag:Rh | 97:3 | 70 | 0.4 |
| EX. 21 | Ag:V | 95:5 | 115 | 0.7 |
| COMP. | | | | |
| EX. 10 | Ag:Ni | 90:10 | 200 | 1.0 |
| EX. 11 | Ag:Ni | 99.8:0.2 | 280 | 0.5 |
| EX. 12 | Ag:Ni | 75:25 | 150 | 2.5 |
| EX. 13 | Ag:Fe | 75:25 | 90 | 1.1 |
| EX. 14 | Ag:Co | 99.8:0.2 | 300 | 0.6 |

It should be appreciated that, as would be clear in view of the above TABLE IV, the electric contacts of, for example, EXAMPLES 12 to 14 of the present invention have shown more excellent properties in the welding and contact resistance than those of COMPARATIVE EXAMPLES 10 to 12, and that the contacts employing other metal than Ni for the metal B according to the present invention were also superior. In the case of the contacts according to COMPARATIVE EXAMPLES, even the one of the mixing ratio of, for example, Ag 90 wt% and Ni 10 wt% has involved such larger Ni particles as to be 40 to 50 μm present as scattered in the electric contact material, which should have caused the number of welding to be remarkably increased.

What we claim as our invention is:

1. A method for manufacturing a strengthened composite conductive material, comprising:

forming a melt of a matrix metal selected from the group consisting of gold, silver and copper and at least a second metal, the second metal being solid insoluble with the matrix metal at ambient temperature and being in admixture with the matrix metal in an amount of from 0.5 to 20 wt% of the melt weight;

dispersing the second metal in the melt; and rapidly cooling and solidifying the melt by atomization and forming uniformly distributed particles of the second metal in the matrix metal, the particles being from 0.1 μm to less than 1 μm in size.

2. A method according to claim 1, wherein Ag is employed as said first matrix metal, and at least one selected from a group consisting of Ni, Cr, Fe, Co, Si, Rh and V is employed as said second metal.

3. A method according to claim 1, wherein Au is employed as said first matrix metal, and at least one selected from a group consisting of Ge, Si, Sb and Rh is employed as said second metal.

4. A method according to claim 1, wherein Cu is employed as said first matrix metal, and Fe is employed as second second metal.

5. A method according to claim 1, wherein said rapid cooling of said melt for said solidification is carried out at a cooling rate of more than $10^{4}$° C./sec.

6. A method according to claim 1, wherein said atomization of said melt is a rotating water atomization.

7. A method according to claim 1, wherein said atomization of said melt is a high pressure gas atomization.

8. A method according to claim 6, wherein said rotating water atomization is carried out with a melt-jetting nozzle of a hole diameter 0.05 to 0.5 mm and at a cooling liquid rate of more than 200 m/min.

9. A method according to claim 7, wherein said high pressure gas atomization is carried out with a melt-jetting nozzle of a hole diameter less than 7 mm and under an atomizing gas pressure of 25 kg/cm$^2$.

* * * * *